US006997312B1

(12) United States Patent
Reum-Schindler

(10) Patent No.: US 6,997,312 B1
(45) Date of Patent: Feb. 14, 2006

(54) BALL CADDY

(76) Inventor: Lisa A. Reum-Schindler, 6281 Chalimar Rd., San Angelo, TX (US) 76904

( * ) Notice: Subject to any disclaimer, the term of this patent is extended or adjusted under 35 U.S.C. 154(b) by 0 days.

(21) Appl. No.: 10/982,151

(22) Filed: Nov. 4, 2004

(51) Int. Cl.
*B65D 85/58* (2006.01)

(52) U.S. Cl. ..... 206/315.9; 224/919

(58) Field of Classification Search ..... 206/315.1, 206/315.9, 315.91; 221/64, 303, 307; 224/191, 224/251, 918, 919
See application file for complete search history.

(56) References Cited

U.S. PATENT DOCUMENTS 5,641,103 A * 6/1997 Potik et al. ..... 206/315.9
5,772,090 A * 6/1998 Rodriguez ..... 206/315.9
5,839,631 A * 11/1998 Hebert et al. ..... 206/315.9
6,029,850 A * 2/2000 Pate et al. ..... 206/315.9
6,234,307 B1 * 5/2001 Beck ..... 206/315.9

* cited by examiner

*Primary Examiner*—Luan K. Bui
(74) *Attorney, Agent, or Firm*—DeWitt M. Morgan

(57) ABSTRACT

A device for carrying at least one sports ball, such as a golf ball, including a cylinder which has a given length, an internal diameter, and first and second ends. The length of the cylinder is longer than the diameter of the sports ball to be carried, preferably longer than twice the diameter of the sports ball to be carried. The internal diameter is sufficient to receive such a ball. Preferably, the first end has an opening expandable from the first diameter that is less than the diameter of such ball to a second diameter at least equal to the diameter of such ball, whereby such ball can be inserted in such end. The device also includes a closure for the second end of the cylinder and a mechanism attached to the closure for permitting the device to be grasped and, optionally, attached to another object (e.g., a golf bag). Preferably, the cylinder is made of expandable material and, more preferably, the expandable material is expandable mesh-like material.

10 Claims, 7 Drawing Sheets

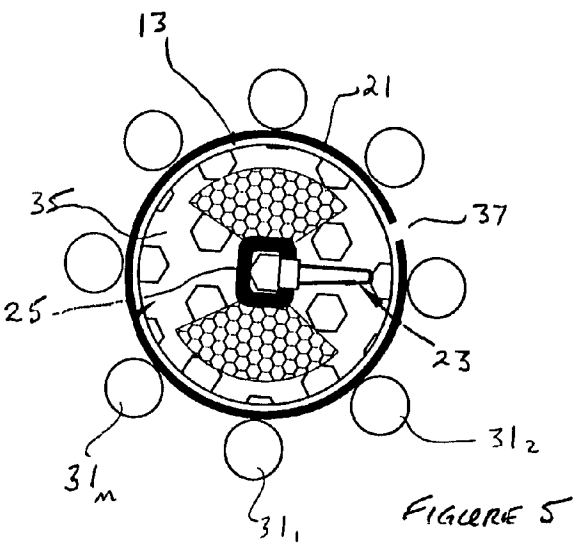
FIGURE 5
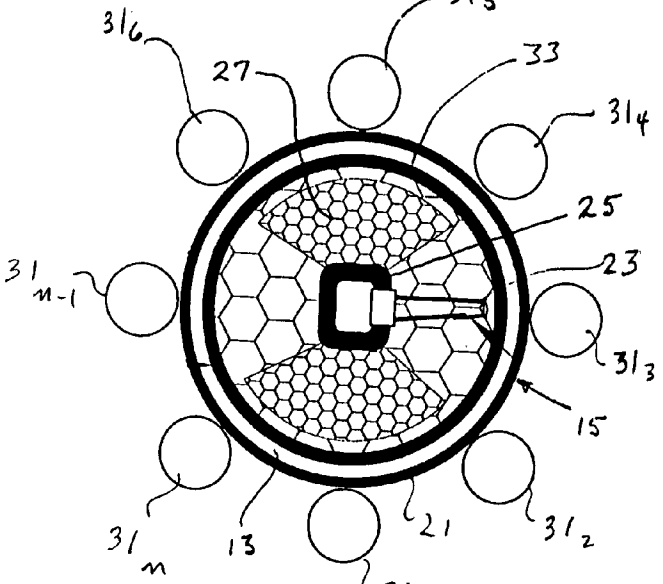
FIGURE 3
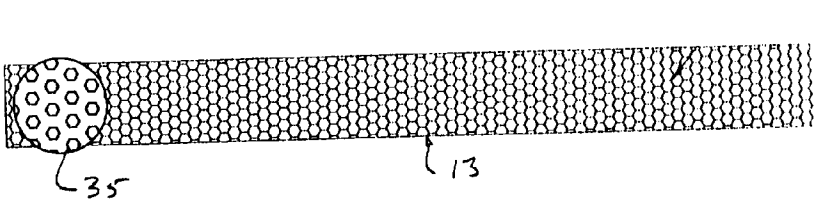
FIGURE 4
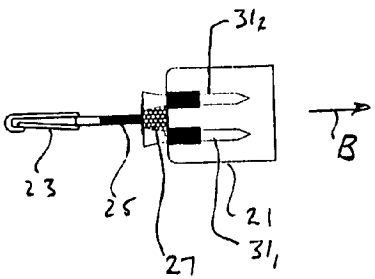

BALL CADDY

FIELD OF THE INVENTION

This invention relates to ball carriers. More specifically, it relates to a caddy for carrying a plurality of balls, such as golf balls.

BACKGROUND OF THE INVENTION

Though sometimes carried in a garment pocket, typically golf balls are carried in a closed pouch on the side of a golf bag. Aside from being inconvenient in that the balls are not visible, the use of such a pouch requires a golfer to dig around in her/his bag to find balls which, in the case of women, may result in broken fingernails. Baseballs and softballs are often carried in sacks or bags.

It is an object of the present invention to provide a ball carrier that is convenient to use, is made of a few components, is easy to manufacture, is lightweight and is easy to store.

It is an additional object of the present invention to provide a ball carrier that permits visible inspection and counting of the number of balls in such carrier without removing the balls from the carrier.

It is a further object of the present invention to provide a ball carrier having the foregoing attributes especially suited to hold golf balls.

It is yet a further object to provide a golf ball carrier (or caddy) which also carries golf tees.

The foregoing and other objects will be apparent to those skilled in the art from the rest of the specification, the claims and the drawings.

SUMMARY OF THE INVENTION

A device, for carrying at least one sports ball, including a cylinder, which has a given length, an internal diameter, and first and second ends. The length of the cylinder is longer than the diameter of the sports ball to be carried, preferably longer than twice the diameter of the sports ball to be carried. The internal diameter is sufficient to receive such a ball. Preferably, the first end has an opening expandable from the first diameter that is less than the diameter of such ball to a second diameter at least equal to the diameter of such ball, whereby such ball can be inserted in such end. The device also includes a closure for the second end of the cylinder and a mechanism attached to the closure for permitting the device to be grasped and, optionally, attached to another object (e.g., a golf bag). Preferably, the cylinder is made of expandable material and, more preferably, the expandable material is expandable mesh-like material. Optionally, where the carrying device is for golf balls, the closure includes a plurality of golf tee holders. The closure member may take the form of a pair of mating members which, when assembled, define a slot for receiving and grasping the second end. The slot includes a plurality of projections which penetrate into the second end to prevent removal of the second end from the slot. Also, optionally, the sports balls can be inserted through an opening in the closure, in which case the opening at the first end does not have to be expandable.

BRIEF DESCRIPTION OF THE DRAWINGS

FIG. 3 is a top, partially schematic, partially cross sectional view of the top closure member of the embodiment of FIGS. 1–2;

FIG. 4 is a partially exploded side view showing an alternate way of interconnecting the mesh cylinder which holds the balls with the closure member;

FIG. 5 is a top, partially schematic, partially cross sectional view of the closure member of the embodiment of FIG. 4;

DESCRIPTION OF THE PREFERRED EMBODIMENT

Figure 1:
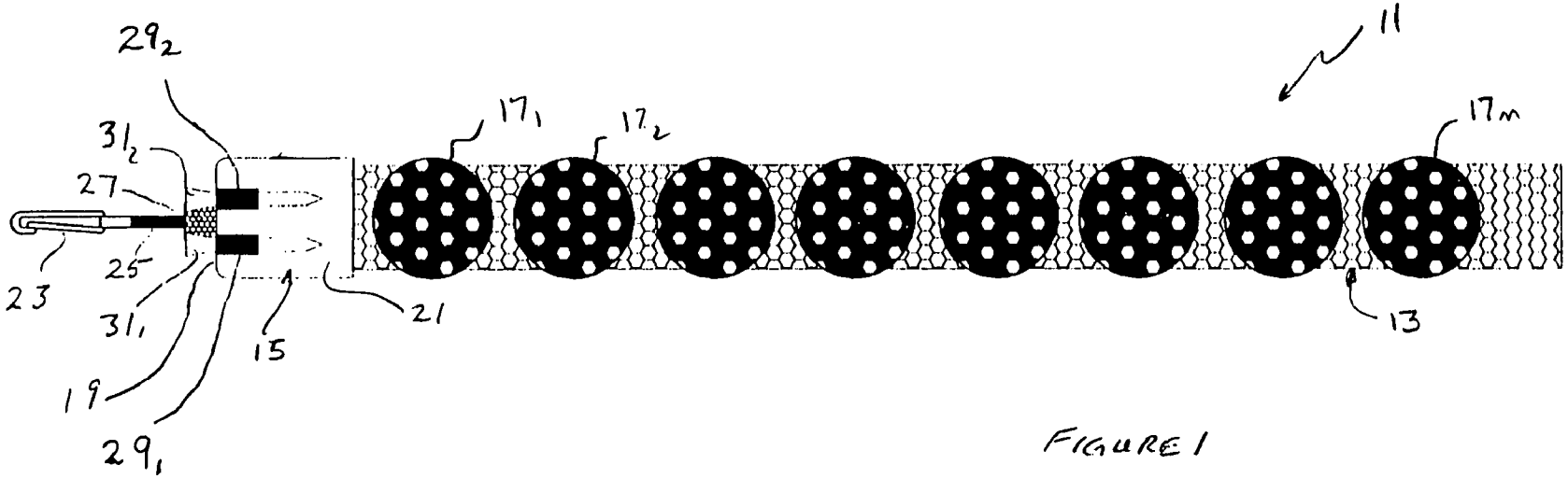
FIG. 1 is the side view of the ball carrier (or caddy) of the present invention, with the golf balls shown primarily in black for purposes of contrast.

With reference to FIG. 1, ball carrier 1 includes a cylindrical mesh tubing 13 and a closure member 15. In the illustrated embodiment, where carrier 11 functions as a golf ball caddy, mesh tubing 13 is a flexible cylindrical tube of polyethlene or polypropylene. For use with golf balls $\mathbf{17}_1$–$\mathbf{17}_n$ (shown primarily in black for purposes of contrast), which are one inch in diameter, the diameter of mesh tube 13 is, approximately, ¾ inches. The length of tube 13 varies, depending on the number of balls to be held. (For clarity, those portions of mesh tubing which are in contact with balls $\mathbf{17}_1$–$\mathbf{17}_n$ are omitted.)

Closure member 15 includes a top portion 19, a cylindrical skirt portion 21, and a standard plastic clip 23, which is connected to top portion 19 by connector 25 and mesh piece 27 (which may be an end portion of mesh tube 13). When ball carrier 11 is a gold ball caddy, skirt 21 can include a plurality of golf tee holders $\mathbf{29}_1$–$\mathbf{29}_n$ as schematically illustrated in, for instance, FIG. 1, for holding up to a like plurality of golf tees $\mathbf{31}_1$, $\mathbf{31}_2$, . . . Clip 23 permits carrier 11 to be attached to, for instance, a golf bag. Clip 23, connector 25 and mesh piece 27 also constitute a grasping mechanism.

Figure 2:
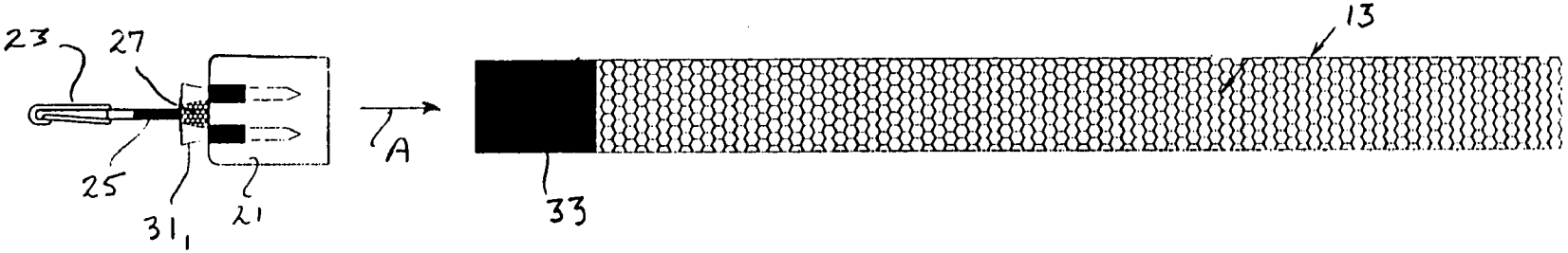
FIG. 2 is a partially exploded side view showing components of the carrier of FIG. 1.

With this embodiment, two ways of connecting closure member 15 to mesh tubing 13 are disclosed. With reference to FIG. 2, a short tubular member 33, such as a section of PVC pipe (shown in black for purposes of contrast), of the appropriate outside diameter, is inserted inside one end of mesh tubing 13. Skirt section 21, which has an inside diameter slightly larger than that of member 33 is forced in the direction of arrow A, over member 33 and mesh 13. See, also, FIG. 3.

In the alternate connection method illustrated in FIG. 4, a whiffle ball 35 is inserted in one end of mesh tubing 13. Skirt portion 21 of closure member 15, having the appropriate inside diameter, is then moved in the direction of arrow B and forced over whiffle ball 35 and the surrounding portion of mesh 13. See FIG. 5. Note that in this version skirt 21 has a relief section in the form of slot 37. (To simplify FIGS. 3 and 5, golf tee holders $\mathbf{29}_1$–$\mathbf{29}_n$ are omitted.)

Figure 6:
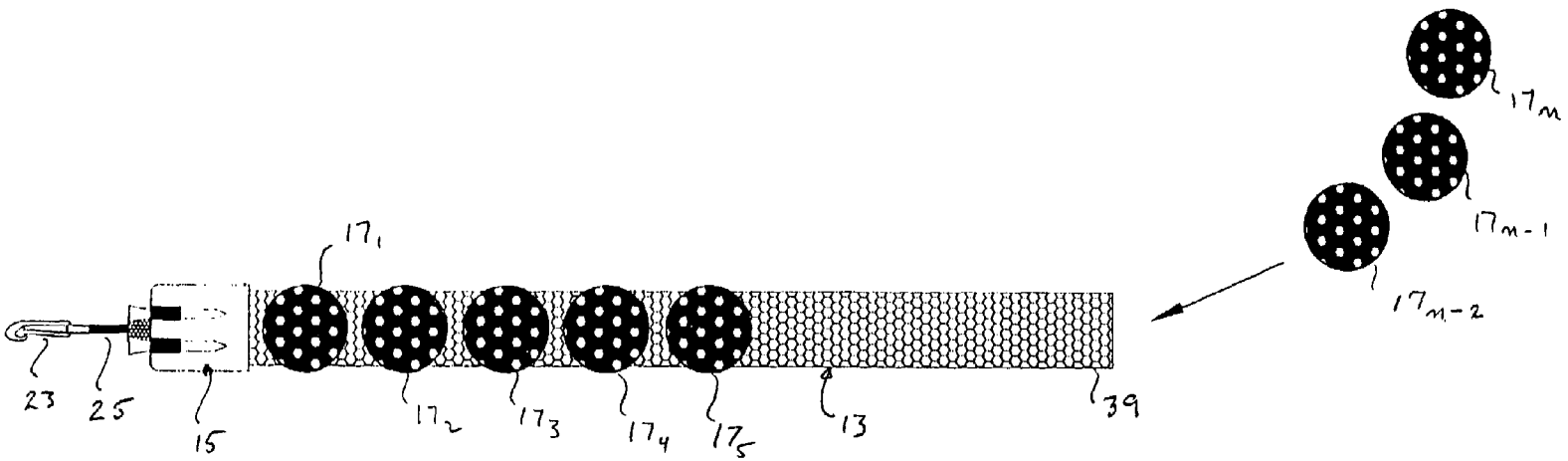
FIG. 6 is an additional side view of the embodiment of FIG. 1, schematically illustrating how balls are inserted into the carrier.
Figure 7:
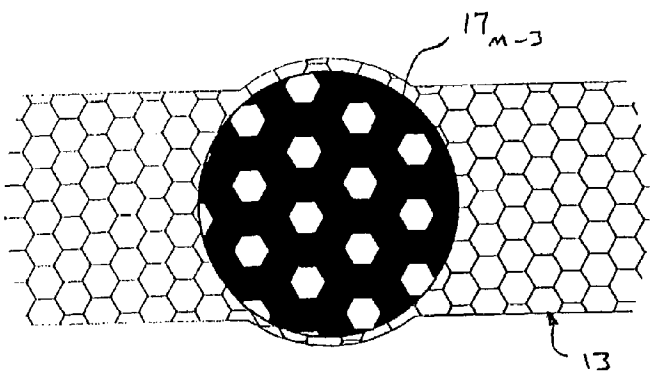
FIG. 7 is an enlarged partial side view of the present invention illustrating how the mesh used to hold the balls (in this case golf balls; again shown primarily in black for purposes of contrast) expands to flow over the ball.

FIG. 6 illustrates the preferred manner of inserting golf balls $\mathbf{17}_1$–$\mathbf{17}_n$ into mesh tubing 13 where it is in the form of a flexible cylindrical mesh tube. The inside diameter of the tube is smaller than the outside diameter of the golf balls $\mathbf{17}_1$–$\mathbf{17}_n$. However, because of the flexible nature of the mesh, end 39 will expand and flow over each golf ball as it is inserted. The mesh, which will expand about ⅛ inch in circumference, will also hold the ball in place and keep it form falling out. This expansion and holding is best illustrated in FIG. 7. (Again, for the purposes of clarity, the golf balls are illustrated primarily in black.)

Two versions of an additional way of closing one end of tubing 13 are illustrated in FIGS. 8–11. In both versions two disks are assembled together to capture one end of mesh tube 13. In one version the end portion of tube 13 is exposed to permit the attachment of a clip. In an alternate version the mesh is not pulled through before being captured, and the clip is molded integrally with one of the two disks.

Figure 8:
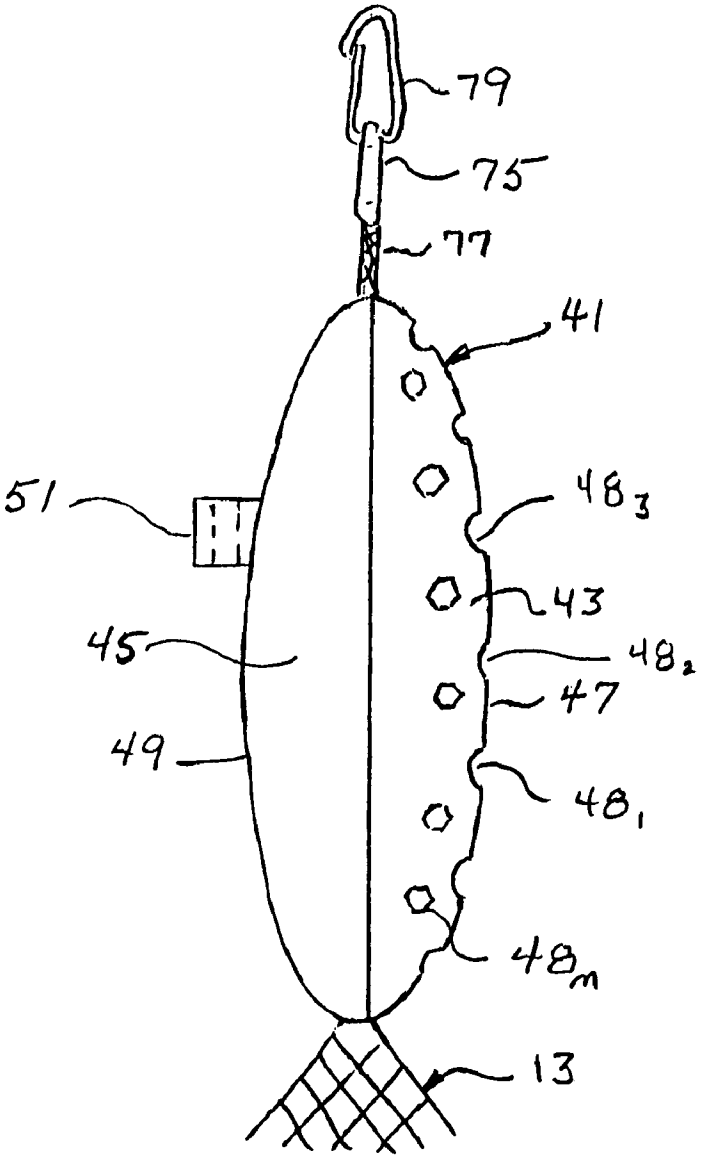
FIG. 8 is a side view of an alternate top closure mechanism.

With reference to FIG. 8, closure member 41 includes front section 43 and back section 45, both of molded plastic. The surface 47 of section 43 may include a plurality of dimples $\mathbf{48}_1$–$\mathbf{48}_n$ to simulate the surface of a golf ball. The surface 49 of section 45 is generally smooth. When carrier 11 is used for golf balls, section 45 also includes a couple of molded tee holders, such as the one illustrated at 51. Either or both or surfaces 47 and 49 may include a logo or other written or graphic matter.

Figures 9A, 9B:
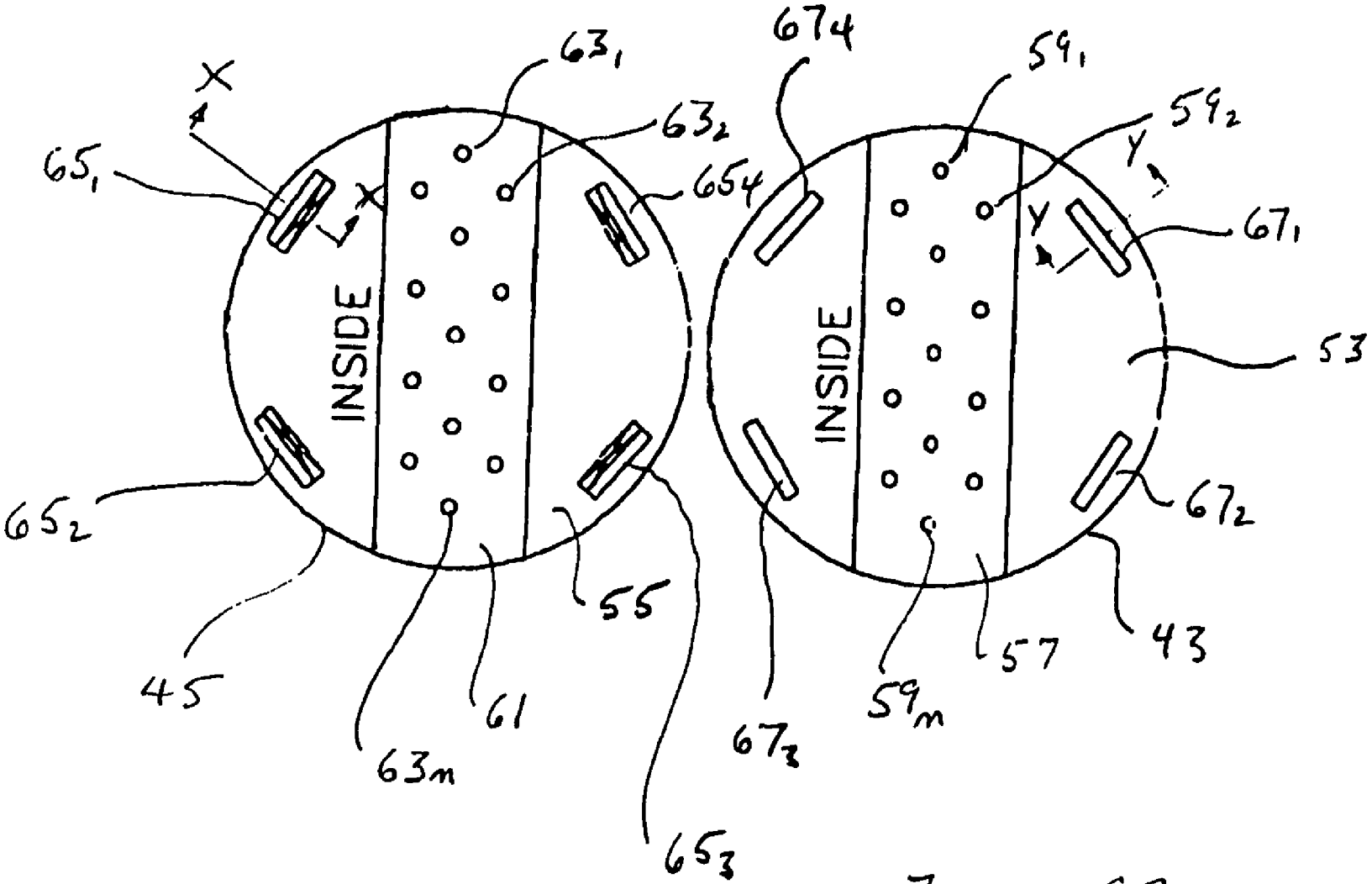
FIGS. 9A and B illustrate the mating halves of the top closure mechanism of FIG. 8.
Figures 10A, 10B, 10C:
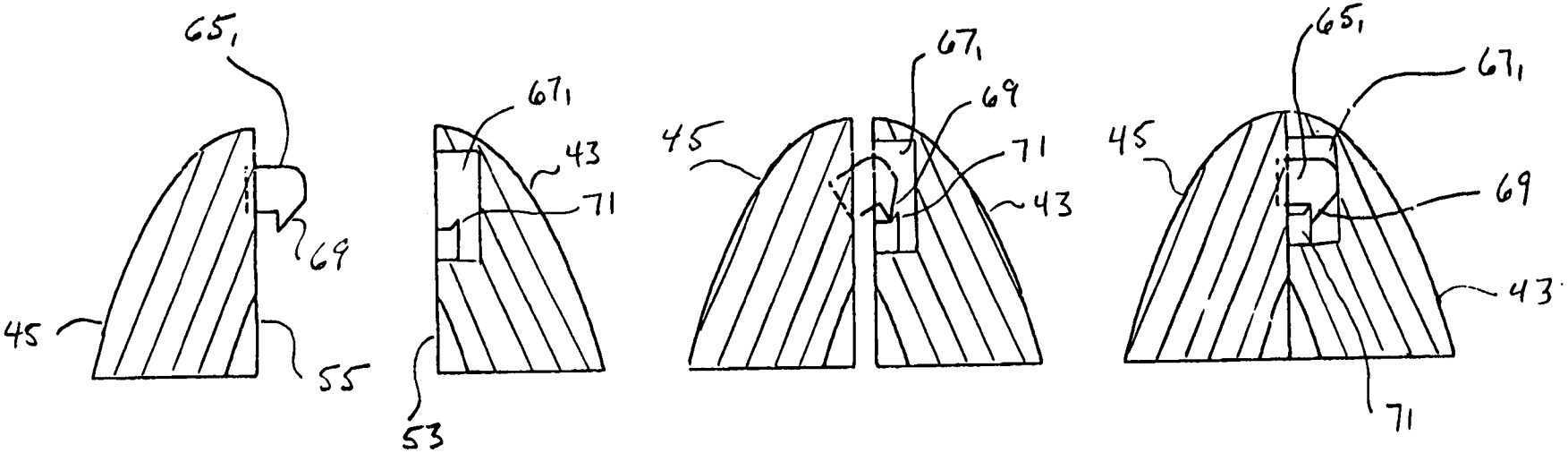
FIGS. 10A, 10B and 10C illustrate details of the latching mechanism.

FIGS. 9A and 9B illustrate the inside, facing surfaces 53 and 55 of section 43 and 45. Surface 53 has a through slot 57 which includes a plurality of molded projecting pins $\mathbf{59}_1$–$\mathbf{59}_n$. Similarly, surface 55 has a through slot 61 which includes a plurality of projecting pins $\mathbf{63}_1$–$\mathbf{63}_n$. As is evident from FIGS. 9A and 9B and FIGS. 10A, 10B, and 10C, which are partial sections taken along sections X—X and Y—Y, surfaces 53 and 55 are mated via a plurality of molded clips $\mathbf{65}_1$–$\mathbf{65}_4$ and a like plurality of mating slots $\mathbf{67}_1$–$\mathbf{67}_4$. Each of clips $\mathbf{65}_1$–$\mathbf{65}_4$ includes a locking projection 69. Each of slots $\mathbf{67}_1$–$\mathbf{67}_4$ includes lip 71. As illustrated in FIGS. 10B and 10C, during assembly, projection 69, rides upon over lip 71, to securely lock in place.

When sections 43 and 45 are locked together, slots 57 and 61 form a through slot (not illustrated) with facing projecting pins $\mathbf{59}_1$–$\mathbf{59}_n$ and $\mathbf{63}_1$–$\mathbf{63}_n$, which securely grip one of the end portions of mesh tube 13 as illustrated in FIG. 8. Connector 75 is attached to end 77 of tube 13 and clip 79 is attached to connector 75.

Figure 11B:
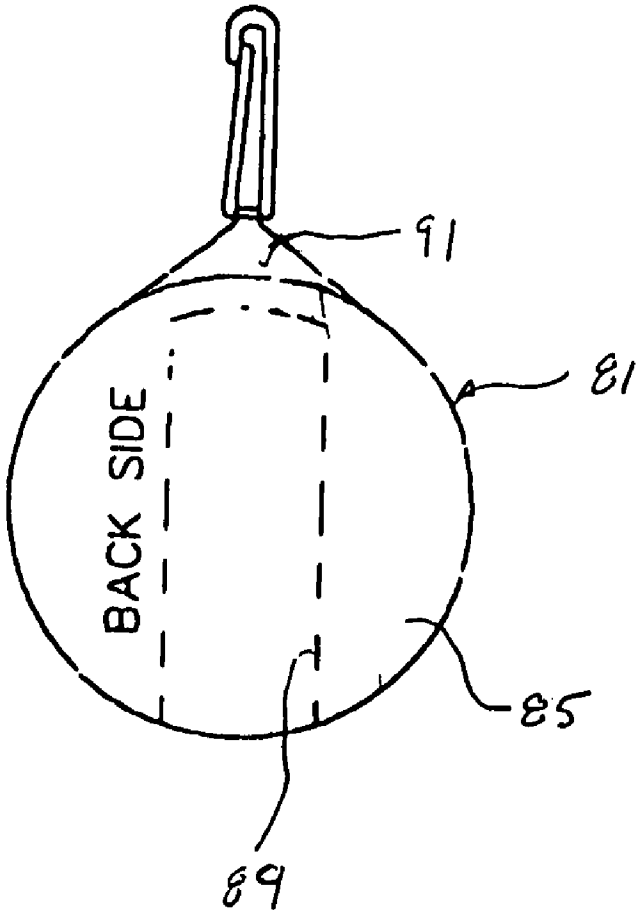
FIGS. 11A and 11B illustrate an alternate version of the top closure mechanism of FIG. 8.
Figure 11A:
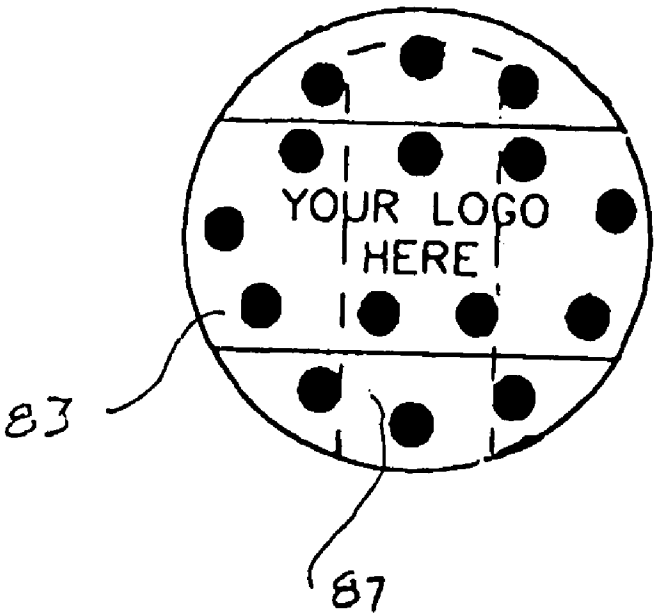

In FIGS. 11A and 11B an alternate version (to the embodiment of FIGS. 8–10C) is disclosed. Closure number 81 includes front section 83 and back section 85. Section 83 is identical to section 43 except that slot 87 (illustrated in broken lines) is closed at the top end. Though not illustrated, slot 87 also includes a plurality of projecting pins like pins $\mathbf{59}_1$–$\mathbf{59}_n$. Similarly, back section 85 includes a closed end slot 89 (also illustrated with broken lines). Again, though not illustrated, slot 89 includes a plurality of projecting pins like pins $\mathbf{63}_1$–$\mathbf{63}_n$. In addition, back section 85 includes a molded projection 91 to which is attached, by any conventional mechanism, to clip 93. Sections 83 and 85 also include a series of mating clips and slots, such as illustrated and described in connection with FIGS. 8–10C to secure the two sections together. So assembled, slots 85 and 87 form a closed end slot with a plurality of opposing projecting pins which securely hold and close one of the ends of mesh tube 13.

Whereas the drawings and accompanying description have shown and described the preferred embodiment of the present invention, it should be apparent to those skilled in the art that various changes may be made in the form of the invention without affecting the scope thereof. For instance, closure member 15 can include a flip up cap (not illustrated) to permit the sports balls to be inserted there through. In such a case, the expandable closure at the opposite end would not be necessary.

I claim:

1. A golf ball caddy for carrying one or more golf balls, said caddy comprising:

a. a tube of expandable mesh-like material, said tube having a length, an internal diameter and first and second ends, said length being longer than the diameter of said golf ball, said internal diameter being smaller than the diameter of said golf ball whereby, when said golf ball is inserted in said first end, said mesh-like material expands to permit the insertion of said golf ball and grasps a portion of the surface of said golf ball;

b. means, attached to said second end, for closing said second end; and c. means, secured to said means for closing, to attach said caddy to another object such as a golf bag.

2. The caddy of claim 1, wherein said length of said cylinder is greater than the diameter of at least two golf balls.

3. The caddy of claim 1, wherein said means for closing includes a plurality of means for holding a plurality of golf tees.

4. The caddy of claim 1, wherein said means for closing includes first and second mating members which, when assembled, define a slot for receiving and grasping said second end.

5. The caddy of claim 4, wherein said slot includes a plurality of projections which penetrate into said second end to prevent removal of said second end from said slot.

6. A device for carrying at least one sports ball, said carrying device comprising:

a. a cylinder, said cylinder having a length, an internal diameter and first and second ends, said length being longer than the diameter of said ball, said internal diameter being sufficient to receive said ball, said first end having an opening expandable from a first diameter less than the diameter of said ball to a second diameter at least equal to said diameter of said ball, whereby said ball can be inserted in said first end;

b. means for closing said second end; and c. grasping means attached to said means for closing.

7. The device of claim 6, wherein said cylinder is made of expandable material.

8. The device of claim 7, wherein said expandable material is expandable mesh-like material.

9. The device of claim 6, wherein said length is greater than twice the diameter of said sports ball.

10. The device of claim 6, wherein said grasping means includes means for permitting said carrying device to be attached to an object.

* * * * *